US009997151B1

(12) United States Patent
Ayrapetian et al.

(10) Patent No.: US 9,997,151 B1
(45) Date of Patent: Jun. 12, 2018

(54) MULTICHANNEL ACOUSTIC ECHO CANCELLATION FOR WIRELESS APPLICATIONS

(71) Applicant: Amazon Technologies, Inc., Seattle, WA (US)

(72) Inventors: Robert Ayrapetian, Morgan Hill, CA (US); Philip Ryan Hilmes, San Jose, CA (US); Yuwen Su, Cupertino, CA (US)

(73) Assignee: Amazon Technologies, Inc., Seattle, WA (US)

( * ) Notice: Subject to any disclaimer, the term of this patent is extended or adjusted under 35 U.S.C. 154(b) by 111 days.

(21) Appl. No.: 15/001,840

(22) Filed: Jan. 20, 2016

(51) Int. Cl.
*H04R 3/02* (2006.01)
*G10K 11/178* (2006.01)

(52) U.S. Cl.
CPC ..... *G10K 11/178* (2013.01); *G10K 11/1786* (2013.01); *G10K 2210/3012* (2013.01); *G10K 2210/3025* (2013.01); *G10K 2210/30232* (2013.01); *G10K 2210/3229* (2013.01)

(58) Field of Classification Search
CPC ..... H04R 1/1083; G10K 11/1786; G10K 11/1788; G10K 11/1784; G10K 11/178; G10K 2210/3012; G10K 2210/30232; G10K 2210/3025; G10K 2210/3229; G10K 2210/1081
USPC ..... 381/71.8, 71.12, 71.1
See application file for complete search history.

(56) References Cited

U.S. PATENT DOCUMENTS 6,421,443 B1 7/2002 Moore et al.
2006/0093128 A1* 5/2006 Oxford ..... H04M 9/082 379/406.01
2009/0214048 A1* 8/2009 Stokes, III ..... H04B 3/23 381/66
2013/0188759 A1* 7/2013 Jain ..... H04L 27/2649 375/343
2014/0003611 A1* 1/2014 Mohammad ..... H04R 3/005 381/66
2014/0024317 A1* 1/2014 Kechichian ..... H04M 1/72536 455/67.13

OTHER PUBLICATIONS

Ahgren. Acoustic Echo Cancellation and Doubletalk Detection Using Estimated Loudspeaker Impulse Responses. Speech and Audio Processing, IEEE Transactions on 13, No. 6, pp. 1231-1237, 2005.
Cheung. Tap Leakage Applied to Echo Cancellation. PhD diss., McGill University, Montreal, 1985.
Murano, et al. Echo Cancellation and Applications. Communications Magazine, IEEE 28, No. 1, pp. 49-55, 1990.
Qi. Acoustic Echo Cancellation Algorithms and Implementation on the TMS320C8x. Texas Instruments Application Report. Digital Signal Processing Solutions. May 1996.
Sondhi, et al. Stereophonic Acoustic Echo Cancellation—An Overview of the Fundamental Problem. Signal Processing Letters, IEEE 2, No. 8, pp. 148-151, 1995.

* cited by examiner

*Primary Examiner* — Matthew Eason
*Assistant Examiner* — Sabrina Diaz
(74) *Attorney, Agent, or Firm* — Pierce Atwood LLP

(57) ABSTRACT

An acoustic echo cancellation (AEC) system that detects and compensates for differences in delay times between the AEC system and a set of wireless speakers. The filter coefficients used for AEC are adjusted based on the determined delay time to correct for frequency domain signal rotation.

20 Claims, 6 Drawing Sheets

MULTICHANNEL ACOUSTIC ECHO CANCELLATION FOR WIRELESS APPLICATIONS

BACKGROUND

In audio systems, automatic echo cancellation (AEC) refers to techniques that are used to recognize when a system has recaptured sound via a microphone after some delay that the system previously output via a speaker (i.e., propagation delay). Systems that provide AEC subtract a delayed version of the original audio signal from the captured audio, producing a version of the captured audio that ideally eliminates the "echo" of the original audio signal, leaving only new audio information. For example, if someone were singing karaoke into a microphone while prerecorded music is output by a loudspeaker, AEC can be used to remove any of the recorded music from the audio captured by the microphone, allowing the singer's voice to be amplified and output without also reproducing a delayed "echo" the original music. As another example, a media player that accepts voice commands via a microphone can use AEC to remove reproduced sounds corresponding to output media that are captured by the microphone, making it easier to process input voice commands.

BRIEF DESCRIPTION OF DRAWINGS

For a more complete understanding of the present disclosure, reference is now made to the following description taken in conjunction with the accompanying drawings.

DETAILED DESCRIPTION

Figure 1:
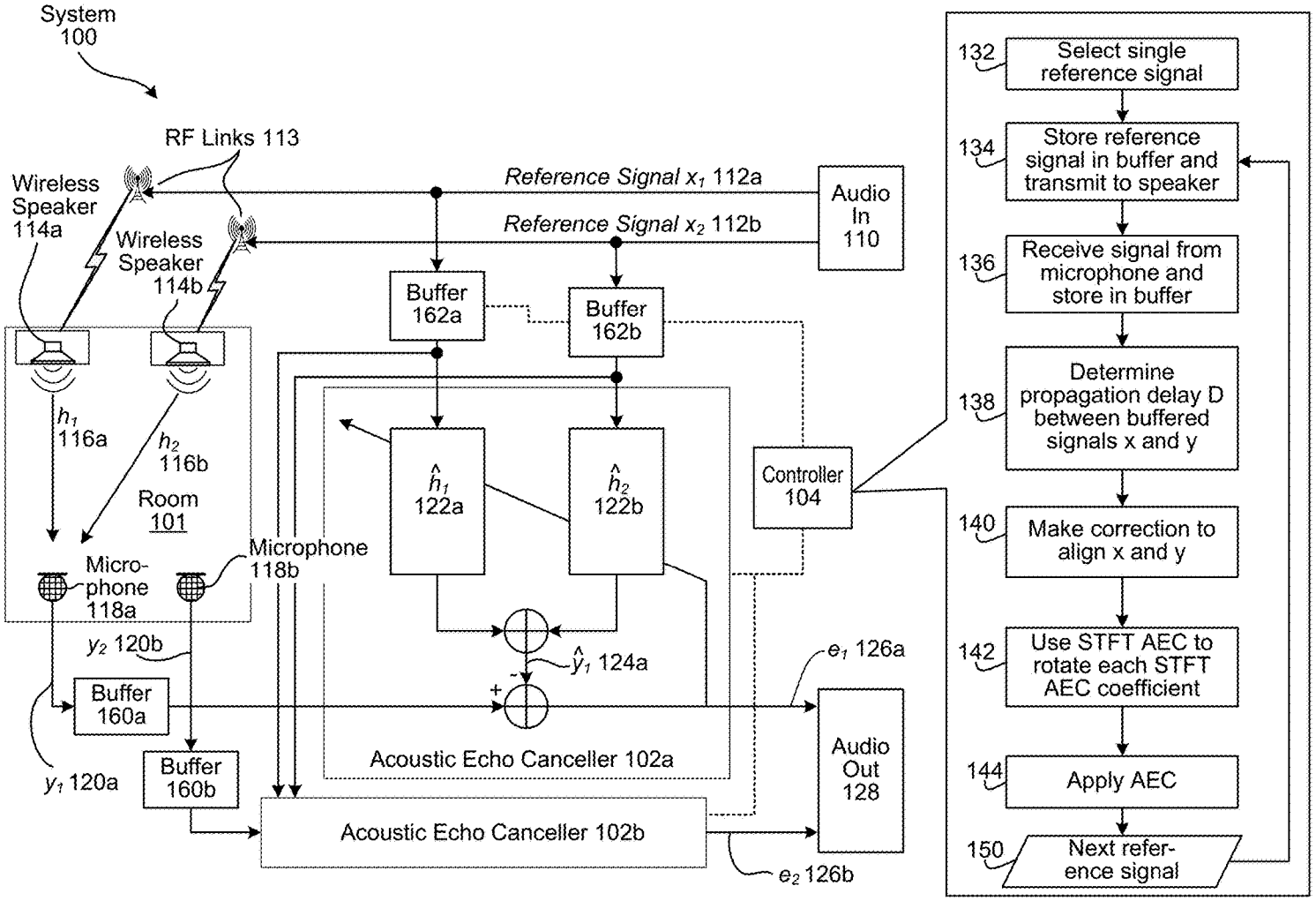
FIG. 1 illustrates an echo cancellation system that compensates for variable signal propagation delays produced by wireless loudspeakers.

AEC for wireless audio applications is challenging. Referring to FIG. 1, if there is a microphone array 118*a*, 118*b* paired with a wireless loudspeaker (e.g., 114*a* or 114*b*), the task of AEC is to cancel the echo at the output of microphone array. In such applications, a reference signal ($x_1$ 112*a*) is transmitted via an RF link 113 to the to the wireless loudspeaker 114*a*. To apply AEC, the true reference signal is required. That is to say, the reference signal $x_1$ 112*a* transmitted to the speaker 114*a* may be different than the true reference signal, which is the signal actually output by the physical loud speaker itself. The AEC device does not have access to that signal.

There are several differences between the references signals $x_1$ 112*a* and $x_2$ 112*b* transmitted to the speakers 114*a* and 114*b*, and the actual reference signal output by the loudspeakers. One differences is clock mismatch between the transmitting device and the loudspeaker. Many electronic devices operate based on a timing "clock" signal produced by a crystal oscillator. For example, when a computer is described as operating at 2 GHz, the 2 GHz refers to the frequency of the computer's clock. This clock signal can be thought of as the basis for an electronic device's "perception" of time. Specifically, a synchronous electronic device may time its own operations based on cycles of its own clock. If there is a difference between otherwise identical devices' clocks, these differences can result in some devices operating faster or slower than others.

In stereo and multi-channel audio systems that include wireless (e.g., Bluetooth) or network-connected loudspeakers and/or microphones, a major cause of problems for conventional AEC is when there is a difference in clock synchronization between loudspeakers and microphones. For example, in a wireless "surround sound" 5.1 system comprising six wireless loudspeakers that each receive an audio signal from a surround-sound receiver, the receiver and each loudspeaker has its own crystal oscillator which provides the respective component with an independent "clock" signal.

Among other things that the clock signals are used for is converting analog audio signals into digital audio signals ("A/D conversion") and converting digital audio signals into analog audio signals ("D/A conversion"). Such conversions are commonplace in audio systems, such as when a surround-sound receiver performs A/D conversion prior to transmitting audio to a wireless loudspeaker, and when the loudspeaker performs D/A conversion on the received signal to recreate an analog signal that is the actual reference signal. The loudspeaker produces audible sound by driving a "voice coil" with an amplified version of the analog signal.

A problem for an AEC system occurs when the audio that the surround-sound receiver transmits to a speaker is output at a subtly different "sampling" rate by the loudspeaker. When the AEC system attempts to remove the audio output by the loudspeaker from audio captured by the system's microphone(s) by subtracting a delayed version of the originally transmitted audio, the playback rate of the audio captured by the microphone is subtly different than the audio that had been sent to the loudspeaker.

For example, consider loudspeakers built for use in a surround-sound system that transfers audio data using a 48 kHz sampling rate (i.e., 48,000 digital samples per second). An actual rate based on a first component's clock signal might actually be 48,000.001 samples per second, whereas another component might operate at an actual rate of 48,000.002 samples per second. This difference of 0.001 samples per second between actual frequencies is referred to as a frequency "offset." The consequences of a frequency offset is an accumulated "drift" in the timing between the components over time. Uncorrected, after one-thousand seconds, the accumulated drift is an entire cycle of difference between components.

In practice, each loudspeaker in a multi-channel audio system may have a different frequency offset to the surround sound receiver, and the loudspeakers may have different frequency offsets relative to each other. If the microphone(s) are also wireless or network-connected to the AEC system (e.g., a microphone on a wireless headset), any frequency offset between the microphone(s) and the AEC system may also contribute to the accumulated drift between the captured reproduced audio signal(s) and the captured audio signals(s).

In addition to clock mismatch, the quirks of signal reproduction by wireless speakers can be unpredictable. Such quirks include sample and/or packet drop and buffering within the wireless speaker 114 which creates variable delay. This can produce compression or decompression variation between the reference signal $x_1$ 112*a* and $x_2$ 112*b*, and the signals $y_1$ 120*a* and $y_2$ 120*b* output by the microphones 118*a*, 118*b*. Another quirk is the non-linearity of loudspeaker coils themselves.

The dominant problem among all above listed problems is a variable propagation delay and clock drift between microphone arrays 118*a*, 118*b* and the wireless loudspeakers 114*a*, 114*b*. Test indicate that traditional textbook AEC will not work. To address this shortcoming of conventional AEC, clock drift and propagation delay estimation and correction needs to be corrected quickly and accurately. The new type of AEC used by the system 100 in FIG. 1 corrects delay and clock offset correction adaptively as part of multi-channel (MC) AEC.

A requirement for convergence of AEC algorithms is to have the correct alignment (delay) between the microphone output signals $y_1$ 120*a*, $y_2$ 120*b* and the reference signals $x_1$ 112*a*, $x_2$ 112*b* that provide most of the echo path energy.

FIG. 1 illustrates a high-level conceptual block diagram of echo-cancellation aspects of a multi-channel AEC system 100. As illustrated, an audio input 110 provides stereo audio "reference" signals $x_1$ 112*a* and $x_2$ 112*b*. The reference signal 112*a* is transmitted to a speaker 114*a*, and the reference signal 112*b* is transmitted to a speaker 114*b*. Each speaker outputs the received audio, and portions of the output sounds are captured by a pair of microphone 118*a* and 118*b*.

The portion of the sounds output by each of the loudspeakers that reaches each of the microphones 118*a*/118*b* can be characterized based on transfer functions. FIG. 1 illustrates transfer functions $h_1$ 116*a* and $h_2$ 116*b* between the loudspeakers 114*a* and 114*b* (respectively) and the microphone 118*a*. The transfer functions vary with the relative positions of the components and the acoustics of the room 101. If the position of all of the objects in a room 101 are static, the transfer functions are likewise static. Conversely, if the position of an object in the room 101 changes, the transfer functions may change.

The transfer functions (e.g., 116*a*, 116*b*) characterize the acoustic "impulse response" of the room 101 relative to the individual components. The impulse response, or impulse response function, of the room 101 characterizes the signal from a microphone when presented with a brief input signal (e.g., an audible noise), called an impulse. The impulse response describes the reaction of the system as a function of time. If the impulse response between each of the loudspeakers 116*a*/116*b* is known, and the content of the reference signals $x_1$ 112*a* and $x_2$ 112*b* output by the loudspeakers is known, then the transfer functions 116*a* and 116*b* can be used to estimate the actual loudspeaker-reproduced sounds that will be received by a microphone (in this case, microphone 118*a*). The microphone 118*a* converts the captured sounds into a signal $y_1$ 120*a*. A second set of transfer functions is associated with the other microphone 118*b*, which converts captured sounds into a signal $y_2$ 120*b*.

The "echo" signal $y_1(k)$ 120*a* contains some of the reproduced sounds from the reference signals $x_1$ 112*a* and $x_2$ 112*b*, in addition to any additional sounds picked up in the room 101. The echo signal $y_1$ 120*a* can be expressed as:

$$y_1 = h_1 * x_1 + h_2 * x_2 \quad [1]$$

where $h_1$ 116*a* and $h_2$ 116*b* are the loudspeaker-to-microphone impulse responses in the receiving room 101, $x_1$ 112*a* and $x_2$ 112*b* are the loudspeaker reference signals, * denotes a mathematical convolution.

The acoustic echo canceller 102*a* calculates estimated transfer functions $\hat{h}_1$ 122*a* and $\hat{h}_2$ 122*b*. These estimated transfer functions produce an estimated echo signal $\hat{y}_1$ 124*a* corresponding to an estimate of the echo component in the echo signal $y_1$120*a*. The estimated echo signal can be expressed as:

$$\hat{y}_1 = \hat{h}_1 * x_1 + \hat{h}_2 * x_2 \quad [2]$$

where * again denotes convolution. Subtracting the estimated echo signal 124*a* from the echo signal 120*a* produces the error signal $e_1$ 126*a*, which together with the error signal $e_2$ 126*b* for the other channel, serves as the output (i.e., audio output 128). Specifically:

$$\hat{e}_1 = y_1 - \hat{y}_1 \quad [3]$$

The acoustic echo canceller 102*a* calculates estimated transfer functions $\hat{h}_1$ 122*a* and $\hat{h}_2$ 122*b* using adaptive filter coefficients. In conventional AEC systems, the adaptive filter coefficients are derived using least mean squares (LMS) or stochastic gradient algorithms, which use an instantaneous estimate of a gradient to update an adaptive weight vector at each time step. With this notation, the LMS algorithm can be iteratively expressed in the usual form:

$$\hat{h}_{new} = \hat{h}_{old} + \mu * e * x \quad [4]$$

where $h_{new}$ is an updated transfer function, $h_{old}$ is a transfer function from a prior iteration, μ is the step size, e is an error signal, and x is a reference signal. The "step size" is a configurable value that corresponds to how fast the echo canceller will converge. A larger step size drives faster convergence, but a smaller step size will drive deeper convergence, meaning that the echo canceller will remove more of the echo.

Applying such adaptation over time (i.e., over a series of samples), it follows that the error signal "e" should eventually converge to zero for a suitable choice of the step size μ (assuming that the sounds captured by the microphone 118*a* correspond to sound entirely based on the references signals 112*a* and 112*b* rather than additional ambient noises, such that the estimated echo signal $\hat{y}_1$ 124*a* cancels out the echo signal $y_1$ 120*a*). However, $e \rightarrow 0$ does not always imply that the actual transfer function h minus the estimated transfer function $\hat{h}$ converges to zero, which is the primary goal of the adaptive filter. For example, the estimated transfer functions $\hat{h}$ may cancel a particular sample or string of samples due to the repetitious nature of audio data, such that the error signal e becomes zero, but in fact may be out of synchronization with the transfer function h, such that the cancellation may be intermittent or transitory. Requiring that the estimated transfer function $\hat{h}$ converges toward equaling the actual transfer function h is the goal of single-channel echo cancellation, and becomes even more critical in the case of multichannel echo cancellers that require estimation of multiple transfer functions.

While drift accumulates over time, the need for multiple estimated transfer functions $\hat{h}$ in multichannel echo cancellers accelerates the mismatch between the echo signal y from a microphone and the estimated echo signal $\hat{y}$ from the echo canceller. To mitigate and eliminate drift, it is therefore necessary to estimate the frequency offset for each channel, so that each estimated transfer function $\hat{h}$ can compensate for difference in component clocks. Many components, however, do not provide accurate clocking information to each other, such that the clocking of components such as wireless microphones and speakers will be unknown to the echo canceller.

The relative frequency offset can be defined in terms of "ppm" (parts-per-million) error between components. The normalized sampling clock frequency offset (error) is a normalized ratio defined as:

$$PPM\ \text{error} = \frac{Ftx}{Frx} - 1 \quad [5]$$

For example, if a loudspeaker (transmitter) sampling frequency Ftx is 48,000 Hz and a microphone (receiver) sampling frequency Frx is 48,001 Hz, then the frequency offset between Ftx and Frx is −20.833 ppm. During 1 second, the transmitter and receiver are creating 48,000 and 48,001 samples respectively. Hence, there will be 1 additional sample created at the receiver side during every second.

For normal audio playback, frequency offset are usually imperceptible to a human being. However, the frequency offset between the crystal oscillators of the AEC system, the microphones, and the loudspeaker will create major problems for multi-channel AEC convergence (i.e., the error e does not converge toward zero). Specifically, the predictive accuracy of the estimated transfer functions (e.g., $\hat{h}_1$ and $\hat{h}_2$) will rapidly degrade as a predictor of the actual transfer functions (e.g., $h_1$ and $h_2$).

For the purpose of explanation, consider a system that includes "N" loudspeakers 114 (N>1) and a separate microphone array system (microphones 118) for hands free near-end/far-end multichannel AEC applications. The frequency offsets for each loudspeaker and the microphone array can be characterized as df1, df2, . . . , dfN. Existing and well known solutions for frequency offset correction for LTE (Long Term Evolution cellular telephony) and WiFi (free running oscillators) are based on Fractional Delayed Interpolator methods. Fractional delay interpolator methods provide accurate correction with additional computational cost. Accurate correction is required for high speed communication systems.

However, audio applications are not high speed and relatively simple frequency correction algorithm may be applied, such as a sample add/drop method. Hence, if playback of reference signals $x_1$ 112(*a*) (corresponding to loudspeaker 114*a*) is signal 1, and the frequency offset between signal 1 and the microphone output signal $y_1$ 120*a* is dfk, then frequency correction may be performed by dropping/adding one sample in 1/dfk samples.

A communications protocol-specific solution to this problem would be to embed a sinusoidal pilot signal when transmitting reference signals "x" and receiving echo signals "y." Using a phase-locked loop (PLL) circuit, components can synchronize their clocks to the pilot signal, and/or estimate the frequency error. However, that requires that the communications protocol between components and each component to support use of such pilot. While such a protocol might be efficient in a closed proprietary system, it would not work in an open framework using off-the-shelf components (e.g., generic Bluetooth wireless loudspeaker).

Another alternative is to transmit an audible sinusoidal signal with the reference signals x 112. Such a solution does not require a specialize communications protocol, nor any particular support from components such as the loudspeakers and microphones. However, the audible signal will be heard by users, which might be acceptable during a startup or calibration cycle, but is undesirable during normal operations. Further, if limited to startup or calibration, any information gleaned as to frequency offsets will be static, such that the system will be unable to detect and compensate for offset changes over time (e.g., due to thermal changes within a component altering frequency of the component's clock).

Another alternative is to transmit an ultrasonic sinusoidal signal with the reference signals $x_n$ (n=1 to N, where N is the number of loudspeakers) at a frequency that is outside the range of frequencies human beings can perceive. A first shortcoming of this approach is that it requires loudspeakers and microphones to each be capable of operating at the ultrasonic frequency. Another shortcoming is that the ultrasonic signal will create a constant sound "pressure" on the microphones, potentially reducing the microphones' sensitivity in the audible parts of the spectrum.

To address these shortcomings of the conventional solutions, the acoustic echo cancellers 102*a* and 102*b* in FIG. 1 determine a delay D (i.e., a time "offset") for each speaker 114 and adapt the filter coefficients of the adaptive filters to approximate the estimated transfer functions $\hat{h}_1$ 122*a* and $\hat{h}_2$ 122*b* to correct for the delays and frequency offsets between components based entirely on the transmitted and received audio signals (e.g., x 112, y 120). No pilot signals are needed, and no additional signals need to be embedded in the audio. Compensation may be performed by adding or dropping samples to eliminate the ppm offset, dropping or adding one sample in 1/dfk samples.

From definition of the PPM error in Equation 5, if the frequency offset is "dfk" ppm, then in 1/dfk samples, one additional sample will be added. Hence, if difference is 1 ppm, then one additional sample will be created in 1/1e−6=$10^6$ samples; if the difference is 20.833 ppm, then one additional sample will be added for every 48,000 samples; and so on. The sample that is added may be, for example, may a duplicate copy of the last of the 48,000 samples (i.e., repeating the last sample in the block determined based on the PPM value "dfk"). If the difference is −1 ppm, then one sample such as the last sample of 1/1e−6=$10^6$ samples will be dropped (i.e., not input into the adaptive filter 122); and so on.

The process is managed by a controller 104 which may be shared amongst the AECs 102. The delay and frequency offset are individually determined for each of the N channels or loudspeakers. A plurality of samples spanning a predetermined interval of the selected (132) reference signal is stored (134) in a buffer 162. The selected reference signal is also transmitted to the corresponding wireless speaker 114 via a radio frequency (RF) link 113, infrared, or other wireless protocol. The buffered interval may be, for example, 500 ms at a defined sampling rate of the reference signal 112, which is also used for sampling by the A/D converters of the microphone array 118, and is ostensibly used the digital-to-analog (D/A) converter wireless speaker 114 to reproduce the audible sounds.

A portion of the audible sound reproduced by the wireless speaker 114 receiving the selected reference signal is captured by the selected microphone 118. The A/D converter associated with the microphone 118 (not illustrated) outputs a signal "y" 120 at the defined sampling rate, which is received and stored (136) in a buffer 160.

After buffering both the reference signal 112 and the microphone signal 120, the system determines (138) the delay D between the buffered signal x and the buffered signal y. Two methods may be used. A first method is time domain cross-correlation of the buffered x and y signals. Another method is to use time domain normalized least mean squares (NLMS) to detect delay variations. Both methods will be discussed further below.

The controller 104 then makes a timing correction to align x and y, adjusting a timing of the buffered microphone signal y 120 relative to the reference signal x 112. This delay in the time domain creates a "rotation" in the frequency domain. A Short Time Fourier Transfer (STFT) is applied (142) to rotate each AEC coefficient W(k) based on the determined delay. AEC is then applied (144), and the process proceeds to adjusting the coefficients for the next reference signal (150). If these steps are performed quickly and accurately, the performance of MC AEC will be significantly improved.

The controller 104 may determine the delay for a single AEC (e.g., 102*a*), determine the timing correction to align x and y, and then apply the correction to all of the AECs (e.g., 102*a*, 102*b*, etc.). As an alternative, the controller 104 may determine the delay for each AEC individually, choosing a microphone and a reference signal and then determining their delay. However, capturing the data for each reference signal and each microphone may require more memory to be dedicated to the process (unless measurements are made sequentially, requiring more time), such that determining the delay for a single AEC and using a same correction across AEC has advantages in terms of memory consumption and computational efficiency, at the cost of some accuracy due to variations in delay in the system 100.

As an alternative approach, the time offset and the propagation delay time may be determined for the signals y 120 from each microphone (e.g., 10 microphones), producing ten propagation delays (e.g., relative to a same reference signal x 112). The mean or median of the propagation delays may be determined, with the mean or median being used by all of the AECs 102.

Clock drift between microphone array and the wireless loudspeakers creates sample add/drop effect in the signals received from the output the microphone array. Hence clock drift creates variation of delay as well. Then, total delay (time offset/delay D) consists of propagation delay plus delay contributed by clock drift. Therefore, delay estimation and correction will fix both: propagation delay and clock drift errors.

A first method of determining the delay D is time domain cross-correlation. Referring to a reference signal x 112 and a microphone signal y 120, assume the range of delay (in samples) is from $$[\text{Min_Delay Max_Delay}] \quad [6]$$

Further, assume that the sampling frequency of the analog-to-digital conversion (ADC) of the microphone arrays is Fs. To define delay, samples of x and y should be collected for "T" seconds, as saved in the buffers 160 and 162, as x_buffer[Ns] and y_buffer[Ns], where Ns=T*Fs.

To compute cross correlation value Rxy(D) for a delay value D (D is from interval between Min_Delay and Max_Delay in [6]), the following double loop is implemented:

```
for (m=Min_Delay; m<Max_Delay; m++)
{
  Rxy[D]=0;
  for(i=Max_Delay; i<Ns+Max_Delay; i++)
  {
  Rxy[D]=Rxy[D]+Rxy(buffer [i]*buffer [i+m]);
  }
  }
```

where the delay is equal to the maximum cross correlation value Rxy(D):

$$\text{Delay}=\text{argmax}\{Rxy[D]\} \quad [7]$$

The total amount of multiplications would be:

$$\text{Total_Cycles}=2*\text{Max_delay}*Ns. \quad [8]$$

To get accurate value of estimated delay from Equation [7], the required duration of collected data may be, for example, more than 8 seconds (i.e., T>8 second). The range of possible delays could be in a range of 1 second, for an example sampling frequency Fs=16 KHz (i.e., 16e3 Hz). To optimize Equation [7], decimation is applied. Clock drift creates bigger rotations for high frequency tones than for low frequency tones. Rotation is proportional to:

$$2*\text{pi}*f*\text{clock_drift}. \quad [9]$$

Hence, decimation will reduce frequency range and decimated signal will not be impacted by clock drift variations. Decimation will reduce amount of data which should be processed for cross-correlation.

For example, at a sampling frequency Fs=16e3, collecting 8 seconds of data for processing, T=8 seconds. Then, if decimation factor is 8, then, the max available frequency in a decimated signal would be 1 kHz and the duration of collected data would be 1 sec.

For audio applications are based on frames, a common frame processing time is 8 to 10 ms. Then, an inner loop may be computed for each frame time as:

```
for (i=Max_Delay; i<N+Max_Delay; i++)
{
  Rxy[D]=Rxy[D]+Rxy(buffer [i]*buffer [i+m]);
  }
```

for a few values of m (let say 1% of total delay values m).

Figure 2:
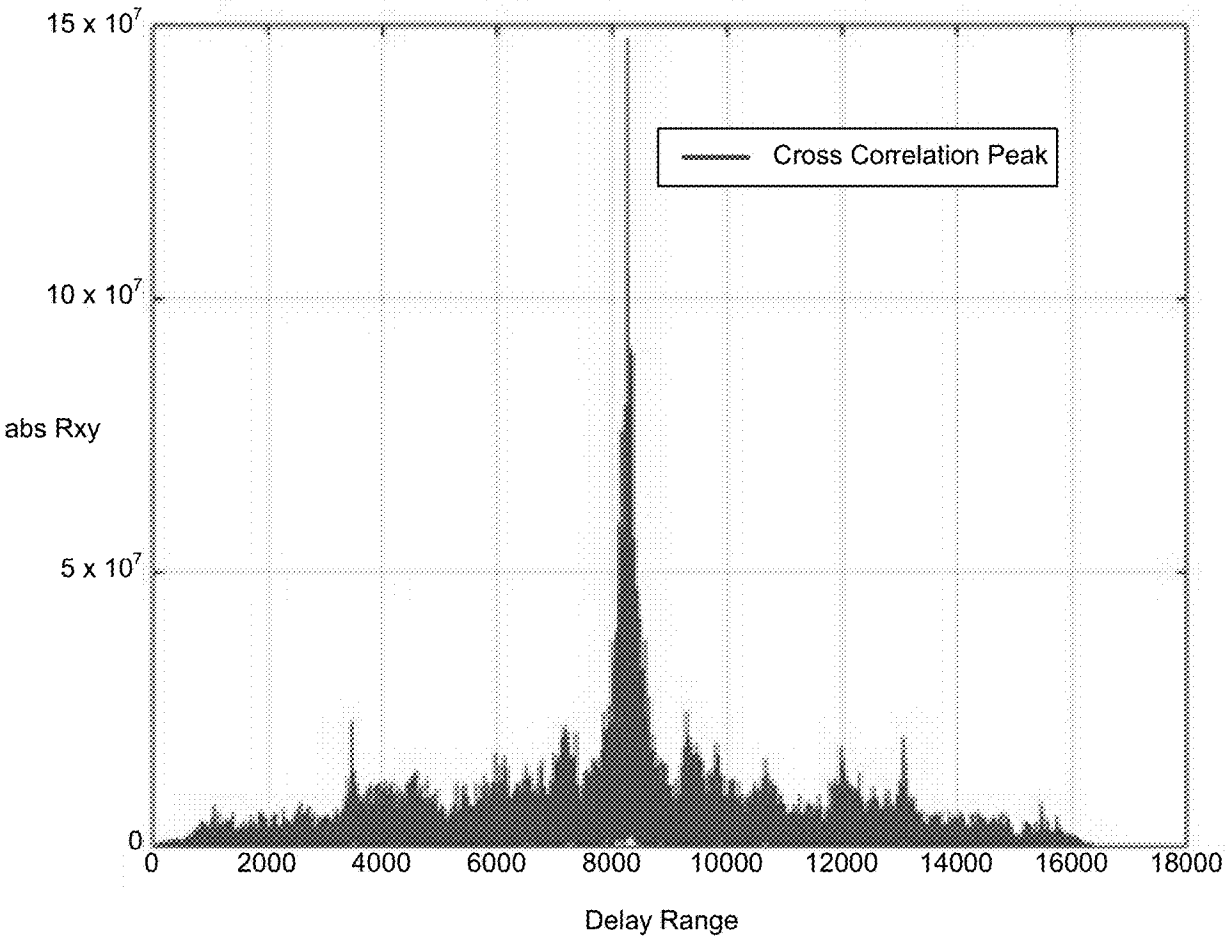
FIG. 2 illustrates a cross correlation peak.

Applying above optimizations will significantly (<1%) reduce the computational cost of cross-correlation. FIG. 2 illustrates an example of a resulting cross correlation peak.

Another method of determining delay is to apply time domain normalized least mean squares (NLMS) to detect delay variation of the peak of the impulse response of the AEC. If delay changes slowly, then AEC will follow delay variation and as a result the peak position will be changed.

For example, assume the range of delay variation is 512 ms. Then, to be able to detect such a big delay variation, the AEC tail length should be greater than 512 ms. The "tail length," in the context of AEC, is a parameter that is a delay offset estimation. For example, if the STFT processes tones in 8 ms samples and the tail length is defined to be 240 ms, then Mp=240/8 which would correspond to Mp=32, where there are "Mp" taps, each tap corresponding to a sample of the signal at a different time/frame. The AEC with 512 ms tail length will take many computational cycles to process.

To reduce the number of computational cycles, decimation should be applied. As was mentioned above, decimation reduces frequency range and as a result, AEC performance will be less impacted by clock drift. Decimation significantly reduces the computational cost.

Figure 3:
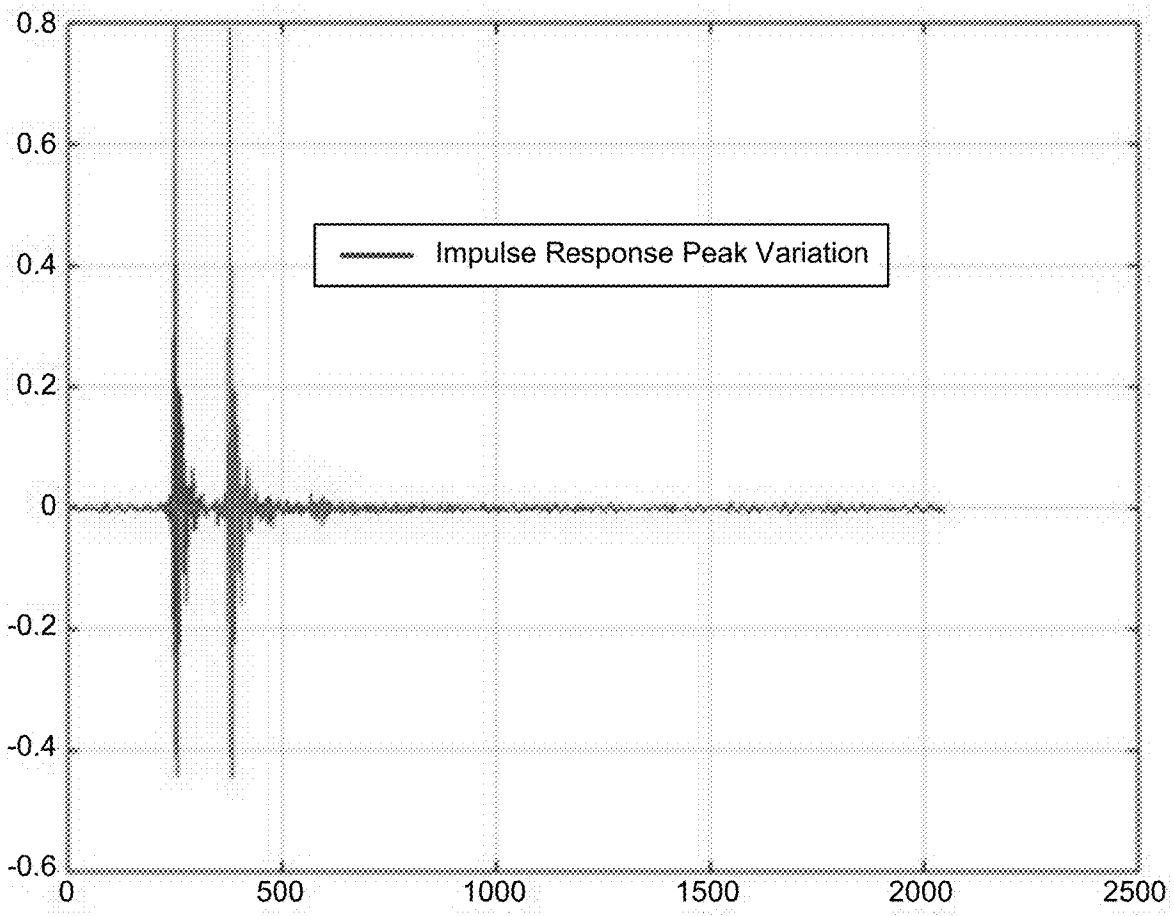
FIG. 3 illustrates impulse response peak variation.

For example, if Fs=16 kHz and the delay variation range is 512 ms, then decimation by 8 will reduce AEC tail length to 64 ms and highest available frequency would be 1 kHz. A low pass filter may be applied to the samples prior to decimation to improve the accuracy of the results. FIG. 3 illustrates the resulting impulse response peak variation.

The h updated according to standard LMS algorithm:

$$h_{new}=h_{old}+\mu\cdot e\cdot x \quad [10]$$

When the convergence occurs, the offset can be measured to determine delay.

Figure 4:
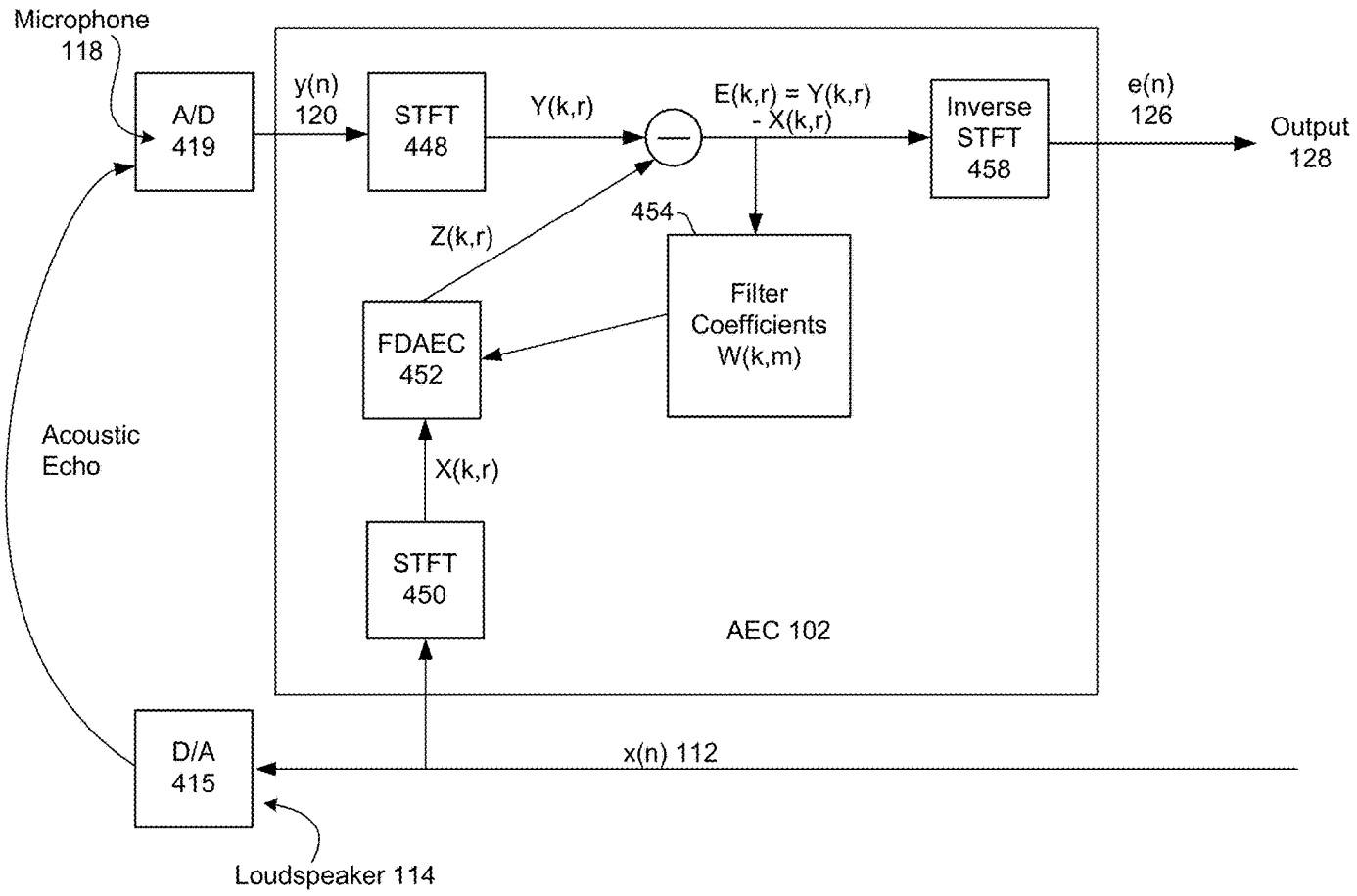
FIG. 4 illustrates compensates for propagation delay offsets in frequency domain.

STFT 448 is then applied to rotate each AEC filter coefficient 454. In FIG. 4, the acoustic echo cancellers 102*a* and 102*b* correct for frequency offsets between components based entirely on the transmitted and received audio signals (e.g., x 112, y 120) using frequency-domain calculation. No pilot signals are needed, and no additional signals need to be embedded in the audio. Compensation may be performed by adding or dropping samples to eliminate the ppm offset.

From definition of the PPM error in Equation 5, if the frequency offset is "α" ppm, then in 1/α samples, one additional sample will be added. This may be performed, for example, by adding on a duplicate of the last sample every 1/α samples. Hence, if difference is 1 ppm, then one additional sample will be created in $1/1e-6=10^6$ samples; if the difference is 20.833 ppm, then one additional sample will be added for every 48,000 samples; and so on. Likewise, if the frequency offset is "−α" ppm, then in 1/α samples, one additional sample will be dropped. This may be performed, for example, by dropping/skipping the last sample every 1/α samples.

For the purposes of discussion, an example of system 100 includes "N" loudspeakers 114 (N>1) and a separate microphone array system (microphones 118) for hands free near-end/far-end multichannel AEC applications. The frequency offsets for each loudspeaker and the microphone array can be characterized as df1, df2, . . . , dfN. If playback of reference signals $x_1$ 112(*a*) (corresponding to loudspeaker 114*a*) is signal 1, and the frequency offset between signal 1 and the microphone output signal $y_1$ 120*a* is dfk, then frequency correction may be performed by dropping/adding one sample every 1/dfk samples.

The acoustic echo canceller(s) 102 use short time Fourier transform-based frequency-domain multi-tap acoustic echo cancellation (STFT AEC) to estimate frequency offset. The following high level description of STFT AEC refers to echo signal y (120) which is a time-domain signal comprising an echo from at least one loudspeaker (114) and is the output of a microphone 118. The reference signal x (112) is a time-domain audio signal that is sent to and output by a loudspeaker (114). The variables X and Y correspond to a Short Time Fourier Transform of x and y respectively, and thus represent frequency-domain signals. A short-time Fourier transform (STFT) is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency domain representation of that same waveform comprises a plurality of discrete amplitude values, where each amplitude value is for a different tone or "bin." So, for example, if the sound wave consisted solely of a pure sinusoidal 1 kHz tone, then the frequency domain representation would consist of a discrete amplitude spike in the bin containing 1 kHz, with the other bins at zero. In other words, each tone "k" is a frequency index. The response of a Fourier-transformed system, as a function of frequency, can also be described by a complex function.

If the STFT is an "Np" point Fast Fourier Transform (FFT), then the frequency-domain variables would be X(k,r) and Y(k,r), where the tone "k" is 0 to Np−1 and "r" is a frame index. The STFT AEC uses a "multi-tap" process. That means for each tone "k" there are Mp taps, where each tap corresponds to a sample of the signal at a different time. Each tone "k" is a frequency point produced by the transform from time domain to frequency domain, and the history of the values across iterations is provided by the frame index "r."

As an example, if a 256-point FFT is performed on a 16 kHz time-domain signal, the output is 256 complex numbers, where each complex number corresponds to a value at a frequency in increments of 16 kHz/256, such that there is 125 Hz between points, with point 0 corresponding to 0 Hz and point 255 corresponding to 16 kHz.

Hence the STFT taps would be W(k,m), where k is 0 to Np−1 and frame m is 0 to Mp−1. The tap parameter Mp is defined based on tail length of AEC. The "tail length," in the context of AEC, is a parameter that is a delay offset estimation. For example, if the STFT processes tones in 8 ms samples and the tail length is defined to be 240 ms, then Mp=240/8 which would correspond to Mp=32.

Given a signal z[n], the STFT Z(k,r) of x[n] is defined by $$Z(k, r) = \sum_{n=0}^{Np-1} Win(n) * z(n + r * R) * e^{-2pi*k*n/Np} \quad [11]$$

Where, Win(n) is a window function for analysis, k is a frequency index, r is a frame index, R is a frame step, Np is an FFT size, and n is the sample index (n=0, . . . Np−1; samples are z(n+r*R)). The value of "n" is a sample index within a window of length Np, where Np is the number of samples within the time window. Hence, for each block (at frame index r) of Np samples, the STFT is performed which produces Np complex tones X(k,r) corresponding frequency index k and frame index r.

Referring to the Acoustic Echo Cancellation using STFT operations in FIG. 4, y(n) 120 is the input signal from the microphone 118 and Y(k,r) it's the STFT representation:

$$Y(k, r) = \sum_{n=0}^{Np-1} Win(n) * y(n + r * R) * e^{-2pi*k*n/Np} \quad [12]$$

The reference signal x(n) 112 to the loudspeaker 114 has a frequency domain STFT representation:

$$X(k, r) = \sum_{n=0}^{Np-1} Win(n) * x(n + r * R) * e^{-2pi*k*n/Np} \quad [13]$$

W(k,m) is an estimated echo channel for each frequency index k and frame m, where m=0, Mp−1. For each frequency index k there are Mp estimated echo channels W(k,0), W(k,1), . . . , W(k,Mp−1).

The general concept of the AECs 102 in FIG. 4 is a three-stage process comprising (1) filtering, (2) error computation, and (3) coefficient updating. The estimated echo is filtering stage may be defined based on each frequency bin k of the STFT AEC output at frame r being defined as:

$$Z(k, r) = \sum_{m=0}^{Mp-1} X(k, r - m) * W(k, m) \quad [14]$$

where X is two-dimensional matrix that is a frequency-domain expression of a reference signal x 112, k is the tone/bin, m is the tap, and W is two-dimensional matrix of the taps coefficients.

Then, the frequency domain AEC output E(k,r) is computed as an error computation stage comprises:

$$E(k,r)=Y(k,r)-Z(k,r) \quad [15]$$

where E is two-dimensional matrix that is a frequency-domain expression of the error signal e 126, Y is a frequency domain expression of the echo signal y 120, and Z is the result of Equation [14]. On the first iteration, the value of Z(k,r) may be initialized to zero, with the filtering stage output refined over time. Applying the inverse STFT 458 (in FIG. 4) yields the error signal e 126, which is the AEC output 128 in the time domain.

The tap coefficient updating stage of the filter coefficient estimator 454 comprises:

$$W(k,m)_{new}=W(k,m)_{old}+\mu*E(k,r)*X(k,r-m)* \quad [16]$$

where μ is the step size between samples as discussed above with Equation 4, and the superscript asterisk appended on to the matrix X(k, r−m) indicates a transpose of the matrix. In essence, Equation [16] is a frequency domain expression of Equation [4].

The adaptive filtering works to minimize mean square of error for each tone, which can be expressed as:

$$|E(k,r)|^2=|Y(k,r)-Z(k,r)|^2\rightarrow 0 \quad [17]$$

Each iteration of Equation [16] improves the accuracy of the coefficient matrix W(k,m), whereby Equation [17] converges towards zero.

The STFT tap coefficients W in the matrix W(k, m) may be use to characterize the impulse response of the room 101. As noted above, each tone "k" can be represented by a sine wave of a different amplitude and phase, such that each tone may be represented as a complex number. A complex number is a number that can be expressed in the form a+bj, where a and b are real numbers and j is the imaginary unit, that satisfies the equation $j^2=-1$. A complex number whose real part is zero is said to be purely imaginary, whereas a complex number whose imaginary part is zero is a real number. As the representation of each tone k is a complex value, each entry in the matrix W(k, m) may likewise be a complex number.

The statistical behavior of the values of each tap coefficient W does not depend of the reference signal x (112). Rather, if there is no frequency offset between the microphone echo signal y (120) and the loudspeaker reference signal x (112) then each "W" tap coefficient will have a zero mean phase rotation. In the alternative, if there is a frequency offset (equal to a PPM) between y and x, then frequency offset will create continuous delay (i.e., will result in the adding/dropping of samples in the time domain). Such a delay (i.e., the time offset/delay D) will correspond to a phase "rotation" in frequency domain.

Figure 5:
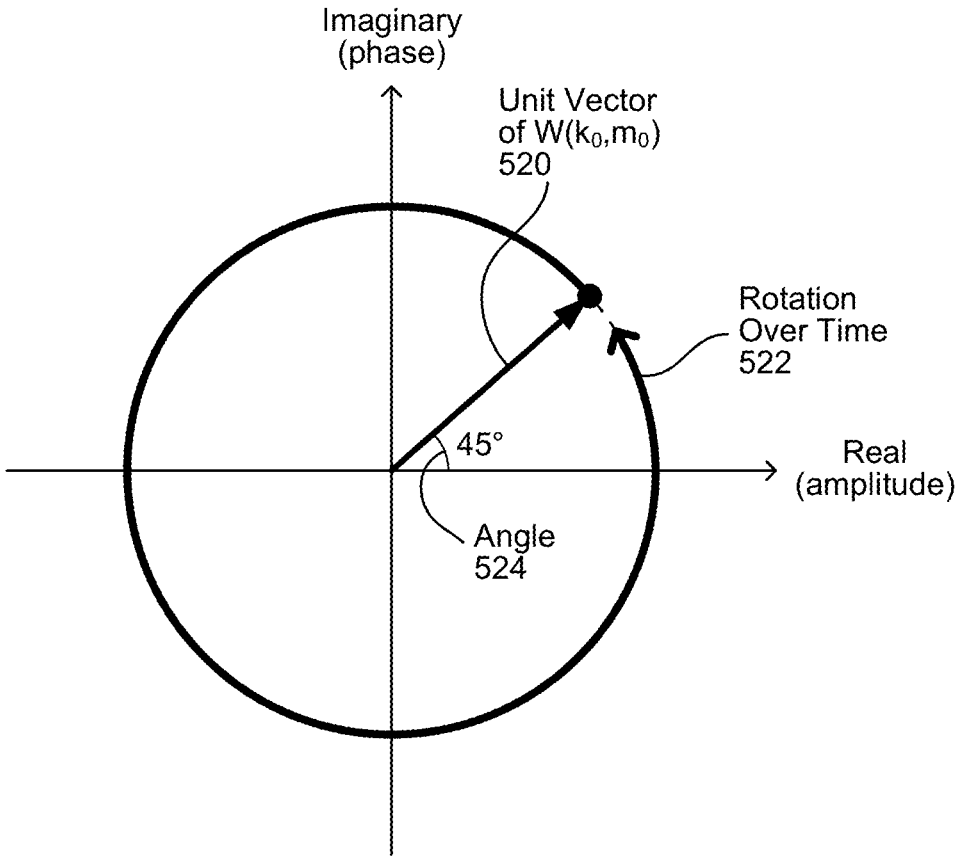
FIG. 5 illustrates the relationship between a complex filter coefficient, its angle, and the rotation of the coefficient over time.

FIG. 5 illustrates phase rotation. A unit vector of the tap coefficient $W(k_0, m_0)$ 520 corresponds to a sinusoid with a real magnitude of 1 and a phase of j. However, it is not necessary to take a unit vector, and instead the complex value may be normalized. Plotted onto a "real" amplitude axis and an "imaginary" phase axis, each complex value results in a two-dimensional vector with a magnitude of 1 and an angle 524 of 45 degrees. However, if there is a frequency offset, a plot of the tap coefficient will begin to rotate over time (illustrated as rotation 522. Moreover, adjusting for the delay D causes rotation. If the frequency offset α is positive, the rotation 522 will be counterclockwise. If the frequency offset α is negative, the rotation 322 will be counterclockwise. The speed angle changes due to the rotation over time 522 from frame to frame corresponds to the size of the offset α, with a larger offset α producing a faster rotation than a smaller offset.

Based on the frequency domain phenomena of the rotation of the tap coefficients corresponding to the magnitude of the frequency offset, each acoustic echo canceller 102 identifies and compensates for the frequency offsets. If there frequency offset α in the system 100, then a change in a delay line in time domain (because frequency offset) will introduce rotation for each W(k,r), because the AEC 102 will try to minimize error as defined in Equation [17]. Now, as was described, if the frequency offset is "α" ppm, then each tone k and for each frame time, the tap coefficients W(k,r) will be rotated by 2*pi*k*α radians.

If x(t) is the time domain signal and X(f) is the corresponding Fourier transform of x(t), then the Fourier transform of x(t−D) would be X(f)*exp(−j*f*D). If the echo cancellation algorithm is designed with long tail length (the number of taps of AEC frequency impulse response (FIR) filter is long enough), then the AEC will converge with initial D taps close to zero. Simply, AEC will lose first D taps. If the delay D is large (e.g., D could be 100 ms or larger), then impact on AEC performance will be large. Hence, the delay D (i.e., time offset) should be measured and should be compensated.

With D samples delay, the error "E" is calculated as:

$$\text{Error}(k) = Y(k) - \sum_{m=0}^{M-1} X(k, r-m) * W(k, m) * \exp\left(-j*2*pi*k*\frac{D}{Np}\right) \quad [18]$$

Where, Np is the number of "points" of the FFT used for the STFT and k is a bin index.

The rotation of the AEC coefficients W(k,m) may be determined directly from:

$$\exp\left(-j*2*pi*k*\frac{D}{Np}\right) \quad [19]$$

For each bin index k, there are Mp taps: W(k,m), m=0, 1, . . . , Mp−1. For each bin index k, calculations may use the first index m=0. For simplicity, denote $W_{no_delay}(n)=W(k,0)$. Hence, if the delay is D, the coefficient W(k,0) with delay may be determined (142) by rotating each coefficient:

$$W_{new}(k) = W_{old}(k)*\exp\left(-j*2*pi*k*\frac{D}{Mp}\right) \quad [20]$$

where Mp is a STFT size and k=0, 1, . . . Mp/2.

Assume the frequency offset between the A/D converter 419 of microphone 118 and the D/A converter 415 of loudspeaker 114 is a ppm. Further assume that for frequency index/bin "k," the echo channel and estimated echo channel is H(k,r) and W(k,r) respectively. If y(n) 120 is the time-domain microphone output and corresponding STFT output is Y(k,f), then (ignoring noise):

$$Y(k,r)=H(k,r)*X(k,r)*e^{j*2*pi*k*\alpha*r} \quad [21]$$

The FDAEC 452 output Z(k,r) is:

$$Z(k, r) = \sum_{m=0}^{M-1} W(k, m) * X(k, r-m) \quad [22]$$

where W(k,r) is the estimated echo channel and X(k,r) is a reference signal in the frequency domain. A cost function for each frequency bin k is defined as:

$$J(k,\alpha)=|E(k,r)|^2 \quad [23]$$

where:

$$E(k,r)=Y(k,r)-Z(k,r) \quad [24]$$

since:

$$|E(k,r)|^2=E(k,r)*\mathrm{conj}(E(k,r)) \quad [25]$$

(if a complex number is p=u+jv, then conj(p)=u−jv).

The cost function of the LMS (least mean square) algorithm to be minimized is the partial derivative of J(k, α) relative to α, where α ppm is the frequency offset value (referring back to Equation [5]), which should be calculated and is to be set to zero.

$$\frac{\partial}{\partial\alpha}J(k,\alpha)=\mathrm{conj}(E(k,r))^*\frac{\partial}{\partial\alpha}E(k,r)+E(k,r)^*\frac{\partial}{\partial\alpha}\mathrm{conj}(E(k,r)) \quad [26]$$

Using Equation [21], this results in:

$$\frac{\partial}{\partial\alpha}E(k,r)=j*2*pi*k*r*Y(k,r) \quad [27]$$

$$\frac{\partial}{\partial\alpha}\mathrm{conj}(E(k,r))=-j*2*pi*k*r*\mathrm{conj}(Y(k,r)) \quad [28]$$

Then, using Equations 26 to 28 produces:

$$\frac{\partial}{\partial\alpha}J(k,\alpha)= j*2*pi*k*r*[Y(k,r)*\mathrm{conj}(E(k,r)-\mathrm{conj}(Y(k,r))^*E(k,r)] \quad [29]$$

resulting in:

$$Y(k,r)*\mathrm{conj}(E(k,r)-\mathrm{conj}(Y(k,r))*E(k,r)=2*j*\mathrm{Imag}(Y(k,r)*\mathrm{conj}(E(k,r)) \quad [30]$$

Hence, $$\frac{\partial}{\partial\alpha}J(k,\alpha)=-4*pi*k*r*\mathrm{Imag}(Y(k,r)*\mathrm{conj}(E(k,r)) \quad [31]$$

Then, the update equation of the LMS algorithm of frequency-offset estimation for tone index k would be:

$$\alpha_{new}=\alpha_{old}-\mu*\frac{\partial}{\partial\alpha}J(k,\alpha) \quad [32]$$

where $\alpha_{old}$ is the frequency offset for the current iteration of the algorithm, and $\alpha_{new}$ is the updated frequency offset that will replace $\mu_{old}$ on a next iteration.

The proportional part 2*pi*k should be taken out from Equation [32], to make frequency offset independent of frequency index k. Then, for all frequency tones the $$\alpha_{new}=\alpha_{old}+2*\mu*r*\mathrm{Imag}(Y(k,r)*\mathrm{conj}(E(k,r)) \quad [33]$$

where r is a number of frames between updates, the function "Imag" gives the imaginary part of a complex number, and the function "conj" gives the complex conjugate.

Figure 6:
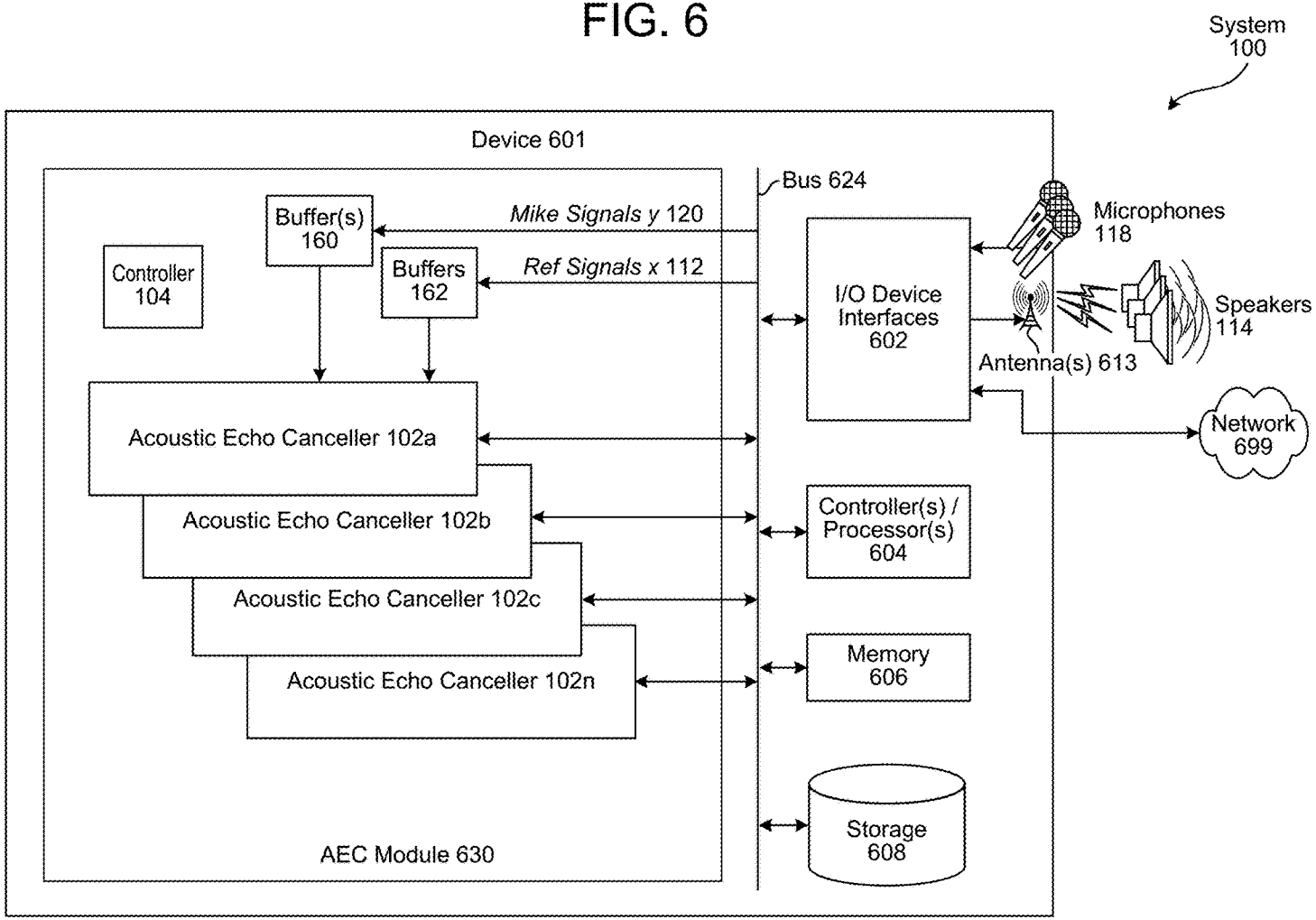
FIG. 6 is a block diagram conceptually illustrating example components of a system for echo cancellation.

FIG. 6 is a block diagram conceptually illustrating example components of the system 100. In operation, the system 100 may include computer-readable and computer-executable instructions that reside on the device 601, as will be discussed further below.

The system 100 may include one or more audio capture device(s), such as a microphone or an array of microphones 118. The audio capture device(s) may be integrated into the device 601 or may be separate.

The system 100 may also include an audio output device for producing sound, such as speaker(s) 116. The audio output device may be integrated into the device 601 or may be separate. However, for the frequency offset correction to be useful, the clocking of one or both of the audio capture device(s) and audio output devices will be different, which ordinarily means one or both will be separate. A contemplated arrangement is to use the system 100 with wireless speakers 114, such that the speakers 114 will be separate from the device 601, The device 601 may include an address/data bus 624 for conveying data among components of the device 601. Each component within the device 601 may also be directly connected to other components in addition to (or instead of) being connected to other components across the bus 624.

The device 601 may include one or more controllers/processors 604, that may each include a central processing unit (CPU) for processing data and computer-readable instructions, and a memory 606 for storing data and instructions. The memory 606 may include volatile random access memory (RAM), non-volatile read only memory (ROM), non-volatile magnetoresistive (MRAM) and/or other types of memory. The device 601 may also include a data storage component 608, for storing data and controller/processor-executable instructions (e.g., instructions to perform the algorithms illustrated in FIGS. 1, 4, and 9). The data storage component 608 may include one or more non-volatile storage types such as magnetic storage, optical storage, solid-state storage, etc. The device 601 may also be connected to removable or external non-volatile memory and/or storage (such as a removable memory card, memory key drive, networked storage, etc.) through the input/output device interfaces 502.

Computer instructions for operating the device 601 and its various components may be executed by the controller(s)/processor(s) 604, using the memory 606 as temporary "working" storage at runtime. The computer instructions may be stored in a non-transitory manner in non-volatile memory 606, storage 608, or an external device. Alternatively, some or all of the executable instructions may be embedded in hardware or firmware in addition to or instead of software.

The device 601 includes input/output device interfaces 502. A variety of components may be connected through the input/output device interfaces 502, such as the speaker(s) 114, the microphones 118, and a media source such as a digital media player (not illustrated). The input/output interfaces 602 may include A/D converters for converting the output of microphone 118 into signals y 120, if the microphones 118 are integrated with or hardwired directly to device 601. If the microphones are independent, the A/D converters will be included with the microphones, and may be clocked independent of the clocking of the device 601. Likewise, the input/output interfaces 602 may include D/A converters for converting the reference signals x 112 into an analog current to drive the speakers 114, if the speakers are integrated with or hardwired to the device 601. However, if the speakers are independent, the D/A converters will be included with the speakers, and may be clocked independent of the clocking of the device 601 (e.g., conventional Bluetooth speakers).

The input/output device interfaces 602 may also include an interface for an external peripheral device connection such as universal serial bus (USB), FireWire, Thunderbolt or other connection protocol. The input/output device interfaces 602 may also include a connection to one or more networks 699 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc., and associated antenna(s) 613. Non-radio wireless protocols may also be supported, such as use of infrared communications. Through the network 699, the system 100 may be distributed across a networked environment.

The device 601 further includes an AEC module 630 that includes the buffers 160 and 162, and the individual AEC 102, where there is an AEC 102 for each microphone 118.

Multiple devices 601 may be employed in a single system 100. In such a multi-device system, each of the devices 601 may include different components for performing different aspects of the AEC process. The multiple devices may include overlapping components. The components of device 601 as illustrated in FIG. 6 are exemplary, and may be a stand-alone device or may be included, in whole or in part, as a component of a larger device or system. For example, in certain system configurations, one device may transmit and receive the audio data, another device may process the buffered data to determine the frequency offsets, another device may perform AEC, and yet another device my use the error signals e 126 (audio out 128) for operations such as speech recognition.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the AEC module 630 may be implemented by a digital signal processor (DSP).

As used in this disclosure, the term "a" or "one" may include one or more items unless specifically stated otherwise. Further, the phrase "based on" is intended to mean "based at least in part on" unless specifically stated otherwise.

What is claimed is:

1. A method, comprising:

transmitting an audio reference signal to a wireless speaker;

storing samples of the audio reference signal;

outputting audible sound from the wireless speaker;

receiving a first signal from a first microphone, the first signal including a portion of the audible sound;

comparing the first signal with the stored samples of the audio reference signal to determine a first time offset between the first signal and the audio reference signal, the first time offset corresponding to a first propagation delay time, the comparing comprising one of:

performing a cross-correlation of the first signal with the stored samples to determine the first time offset, or performing a normalized least mean squares analysis of the first signal and the stored samples to determine the first time offset;

determining a first filter coefficient for a first adaptive filter based on an exponential function of at least the first propagation delay time; and reproducing the audio reference signal as a first reproduced reference signal so as to have a second time offset relative to the first signal, wherein the second time offset is less than the first time offset.

2. The method of claim 1, further comprising:

applying a short-time Fourier Transform (STFT) to the first signal to determine a first frequency domain signal;

applying the STFT to the first reproduced reference signal to determine a first frequency domain reference signal;

filtering the first frequency domain reference signal using the first adaptive filter with the first filter coefficient to produce a first frequency-domain echo signal as an estimate of a portion of the first frequency domain reference signal present in the first frequency domain signal;

subtracting the first frequency-domain echo signal from the first frequency domain signal to determine a first frequency domain output signal;

applying an inverse STFT to the first frequency domain output signal to produce an echo cancelled time-domain output signal;

reproducing the audio reference signal as a second reproduced reference signal so as to have the first time offset relative to the first signal;

applying the STFT to the second reproduced reference signal to determine a second frequency-domain reference signal;

filtering the first frequency domain reference signal using the first adaptive filter with a second filter coefficient to produce a second frequency-domain echo signal, wherein the first filter coefficient is based on a first product of the second filter coefficient multiplied by the exponential function of the first propagation delay time;

subtracting the second frequency-domain echo signal from the first frequency-domain signal to determine a second frequency domain output signal;

determining a cost function based on a square of a complex magnitude of the second frequency domain output signal;

determining a partial derivative of the cost function; and determining a first frequency offset value based on the partial derivative and a second frequency offset value, wherein the second frequency offset value was determined as the first frequency offset value by a previous iteration of the method.

3. The method of claim 2, wherein determining the partial derivative comprises:

determining a second product of the first frequency domain signal multiplied by a conjugate of the second frequency-domain echo signal;

determining an imaginary number component of the second product; and multiplying the imaginary number component by a number of samples of the first audio reference signal transmitted to the first sound reproduction device since the previous iteration of the method.

4. The method of claim 1, further comprising:

determining a third time offset corresponding to a second propagation delay time between a second signal received from a second microphone and the audio reference signal; and determining a mean or median of a plurality of propagation delay times comprising the first propagation delay time and the second propagation delay time, wherein the exponential function used to determine the first filter coefficient is an exponential function of the mean or median of the plurality of propagation delay times.

5. A computing device comprising:

a processor;

a memory including instructions operable to be executed by a processor that configure the processor to:

wirelessly transmit a first audio reference signal to a first sound reproduction device that is independent of the computing device;

receive a first signal from a microphone, the first signal including a first portion of the first audio reference signal as output by the first sound reproduction device;

perform a time-domain cross-correlation of the first audio reference signal and the first signal, or perform a time-domain normalized least mean squares analysis of the first audio reference signal and the first signal;

determine a first propagation delay time between the first audio reference signal and the first signal based on the time-domain cross-correlation or the time-domain normalized least mean squares analysis;

determine a first filter coefficient of a first adaptive filter based at least in part on the first propagation delay time, wherein the first filter coefficient is determined using an exponential function;

input the first audio reference signal into the first adaptive filter, wherein the first adaptive filter applies the first filter coefficient to the first audio reference signal and outputs a first echo signal corresponding to a first estimate of a first portion of the first audio reference signal included in the first signal; and subtract the first echo signal from the first signal as a first output signal.

6. The computing device of claim 5, wherein the instructions further comprise instructions to:

reproduce the first audio reference signal as a first reproduced reference signal so as to have the first propagation delay time relative to the first signal;

apply a short-time Fourier Transform (STFT) to the first signal to determine a first frequency-domain signal;

apply the STFT to the first reproduced reference signal to determine a first frequency-domain reference signal;

filter the first frequency-domain reference signal using the first adaptive filter with a second filter coefficient to produce a first frequency-domain echo signal, wherein the first filter coefficient is based on a first product of the second filter coefficient multiplied by the exponential function of the first propagation delay time;

subtract the first frequency-domain echo signal from the first frequency-domain signal to determine a first frequency domain output signal;

determine a cost function based on a square of a complex magnitude of the first frequency domain output signal;

determine a partial derivative of the cost function; and determine a first frequency offset value based on the partial derivative and a second frequency offset value, wherein the second frequency offset value was determined in a previous iteration of the instructions.

7. The computing device of claim 6, wherein the instructions to determine the partial derivative comprise instructions to:

determine a second product of the first frequency-domain reference signal multiplied by a conjugate of the first frequency-domain echo signal;

determine an imaginary number component of the second product; and multiply the imaginary component by a number of samples of the first audio reference signal transmitted to the first sound reproduction device since the previous iteration of the method.

8. The computing device of claim 5, wherein the instructions configure the processor to determine the first filter coefficient, to input the first audio reference signal into the first adaptive filter, and to subtract the first echo signal from the first signal in frequency domain.

9. The computing device of claim 8, wherein the instructions further configure the processor to:

apply a short-time Fourier Transform (STFT) to the first audio reference signal, prior to inputting the first audio reference signal into the first adaptive filter; and apply the STFT to the first signal prior to subtracting the first echo signal from the first signal.

10. The computing device of claim 9, wherein the first output signal is in frequency domain, the instructions further configuring the processor to apply an inverse STFT to the first output signal to produce an echo cancelled time-domain output signal.

11. The computing device of claim 5, wherein the instructions further configure the processor to:

determine a second propagation delay time between a second signal received from a second microphone and the first audio reference signal; and determine a mean or median of a plurality of propagation delay times comprising the first propagation delay time and the second propagation delay time, wherein determining of the first filter coefficient is based on the mean or median.

12. The computing device of claim 11, wherein the instructions further configure the processor to:

determine a second filter coefficient of a second adaptive filter based on the mean or median;

input the first audio reference signal into the second adaptive filter, wherein the second adaptive filter applies the second filter coefficient to the first audio reference signal and outputs a second echo signal corresponding to a second estimate of a second portion of the first audio reference signal included in the second signal; and subtract the second echo signal from the second signal as a second output signal.

13. A method performed by a computing device, comprising:

wirelessly transmitting a first audio reference signal to a first sound reproduction device that is independent of the computing device;

receiving a first signal from a microphone, the first signal including a first portion of the first audio reference signal as output by the first sound reproduction device;

performing a time-domain cross-correlation of the first audio reference signal and the first signal, or performing a time-domain normalized least mean squares analysis of the first audio reference signal and the first signal;

determining a first propagation delay time between the first audio reference signal and the first signal based on the time-domain cross-correlation or the time-domain normalized least mean squares analysis;

determining a first filter coefficient of a first adaptive filter based at least in part on the first propagation delay time, wherein the first filter coefficient is determined using an exponential function;

imputing the first audio reference signal into the first adaptive filter, wherein the first adaptive filter applies the first filter coefficient to the first audio reference signal and outputs a first echo signal corresponding to a first estimate of a first portion of the first audio reference signal included in the first signal; and subtracting the first echo signal from the first signal as a first output signal.

14. The method of claim 13, further comprising:

reproducing the first audio reference signal as a first reproduced reference signal so as to have the first propagation delay time relative to the first signal;

applying a short-time Fourier Transform (STFT) to the first signal to determine a first frequency-domain signal;

applying the STFT to the first reproduced reference signal to determine a first frequency-domain reference signal;

filtering the first frequency-domain reference signal using the first adaptive filter with a second filter coefficient to produce a first frequency-domain echo signal, wherein the first filter coefficient is based on a first product of the second filter coefficient multiplied by the exponential function of the first propagation delay time;

subtracting the first frequency-domain echo signal from the first frequency-domain signal to determine a first frequency domain output signal;

determining a cost function based on a square of a complex magnitude of the first frequency domain output signal;

determining a partial derivative of the cost function; and determining a first frequency offset value based on the partial derivative and a second frequency offset value, wherein the second frequency offset value was determined in a previous iteration of the method.

15. The method of claim 14, wherein determining the partial derivative comprises:

determining a second product of the first frequency-domain reference signal multiplied by a conjugate of the first frequency-domain echo signal;

determining an imaginary number component of the second product; and multiplying the imaginary component by a number of samples of the first audio reference signal transmitted to the first sound reproduction device since the previous iteration of the method.

16. The method of claim 13, wherein determining the first filter coefficient, inputting the first audio reference signal into the first adaptive filter, and subtracting the first echo signal from the first signal in frequency domain are performed in frequency domain.

17. The method of claim 16, further comprising:

applying a short-time Fourier Transform (STFT) to the first audio reference signal, prior to inputting the first audio reference signal into the first adaptive filter; and applying the STFT to the first signal prior to subtracting the first echo signal from the first signal.

18. The method of claim 17, wherein the first output signal is in frequency domain, the method further comprising applying an inverse STFT to the first output signal to produce an echo cancelled time-domain output signal.

19. The method of claim 13, further comprising:

determining a second propagation delay time between a second signal received from a second microphone and the first audio reference signal; and determining a mean or median of a plurality of propagation delay times comprising the first propagation delay time and the second propagation delay time, wherein determining of the first filter coefficient is based on the mean or median.

20. The method of claim 19, further comprising:

determining a second filter coefficient of a second adaptive filter based on the mean or median;

inputting the first audio reference signal into the second adaptive filter, wherein the second adaptive filter applies the second filter coefficient to the first audio reference signal and outputs a second echo signal corresponding to a second estimate of a second portion of the first audio reference signal included in the second signal; and subtracting the second echo signal from the second signal as a second output signal.

* * * * *